US007578664B2

(12) United States Patent
Kim et al.

(10) Patent No.: US 7,578,664 B2
(45) Date of Patent: Aug. 25, 2009

(54) OIL SUPPLY STRUCTURE OF SCROLL COMPRESSOR

(75) Inventors: Cheol-hwan Kim, Seoul (KR); Dong-koo Shin, Anyang-si (KR); Yang-hee Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 242 days.

(21) Appl. No.: 11/428,901

(22) Filed: Jul. 6, 2006

(65) Prior Publication Data

US 2008/0008613 A1 Jan. 10, 2008

(51) Int. Cl.
*F04C 18/02* (2006.01)

(52) U.S. Cl. ..... 418/55.6; 418/55.1

(58) Field of Classification Search ..... 418/55.6, 418/55.1

See application file for complete search history.

(56) References Cited

U.S. PATENT DOCUMENTS

| | | | | |
|---|---|---|---|---|
| 5,217,359 | A * | 6/1993 | Kawahara et al. | 418/55.6 |
| 5,931,650 | A * | 8/1999 | Yasu et al. | 418/55.6 |
| 6,386,840 | B1 * | 5/2002 | Williams et al. | 418/55.1 |
| 7,318,711 | B2 * | 1/2008 | Shin et al. | 418/55.6 |
| 2005/0053508 | A1 | 3/2005 | Morozumi et al. | |
| 2005/0135957 | A1 | 6/2005 | Park | |

FOREIGN PATENT DOCUMENTS

| | | | |
|---|---|---|---|
| JP | 04334701 | A * | 11/1992 |
| JP | 4-365983 | A | 12/1992 |
| JP | 8-303378 | A | 11/1996 |
| JP | 2002168183 | A * | 6/2002 |
| JP | 2003-035286 | A | 2/2003 |
| JP | 2003-227480 | A | 8/2003 |

OTHER PUBLICATIONS

English language Abstract of JP 2003-035286 A.
English language Abstract of JP 8-303378 A.
English language Abstract of JP 4-365983 A.
English language Abstract of JP 2003-227480 A.

* cited by examiner

*Primary Examiner*—Thomas E Denion
*Assistant Examiner*—Mary A Davis
(74) *Attorney, Agent, or Firm*—Ked & Associates, LLP

(57) ABSTRACT

Disclosed herein is an oil supply structure of a scroll compressor. The oil supply structure is provided to prevent a slender hole of an oil supply screw from being clogged with sludge, the oil supply screw being provided between a backpressure space, which is defined between an orbiting scroll and a main frame, and a space which is defined between a fixed scroll and the main frame, and adapted to supply oil from the backpressure space into the space. The oil supply screw includes an orifice having a center hole longitudinally perforated through the center of an upper portion of a screw body of the oil supply screw and a slender hole continuously perforated below the center hole to have the same axis as that of the center hole, and a sludge discharger having a non-flat-plane configuration and formed at a lower entrance end of the screw body.

4 Claims, 19 Drawing Sheets

PRIOR ART

PRIOR ART

PRIOR ART

OIL SUPPLY STRUCTURE OF SCROLL COMPRESSOR

BACKGROUND OF THE INVENTION

1. Field of the Invention

The present invention relates to an oil supply structure of a scroll compressor, and more particularly, to an oil supply structure of a scroll compressor for preventing a slender hole of an oil supply screw from being clogged with sludge, the oil supply screw being provided between a backpressure space, which is defined between an orbiting scroll and a main frame, and a space which is defined between a fixed scroll and the main frame, and adapted to supply oil from the backpressure space into the space.

2. Description of the Related Art

A general scroll compressor, as shown in FIG. 1, includes a main frame 2 and sub frame 3 mounted in a shell 1 at upper and lower locations of the shell 1, a stator 4 press-fitted in the shell 1 between the main frame 2 and the sub frame 3, and a rotor 5 disposed in the stator 4 and adapted to rotate by power applied thereto.

A vertical crank shaft 6 is fixedly inserted into the center of the rotor 5 such that opposite ends thereof are rotatably supported by the main frame 2 and sub frame 3, respectively. Then, the vertical crank shaft 6 is rotated along with the rotor 5.

The scroll compressor further includes a compression unit including an orbiting scroll 7 disposed on an upper end surface of the main frame 2, and a fixed scroll 8 located over the orbiting scroll 7 to be secured to an inner periphery of the shell 1. The orbiting scroll 7 has a lower portion coupled to the crank shaft 6 and an upper portion forming an involute orbiting wrap 7*a*. The fixed scroll 8 has a fixed wrap 8*a* configured to be engaged with the orbiting wrap 7*a* in such a manner that a compression chamber 21 is defined between the fixed wrap 8*a* and the orbiting wrap 7*a*. With this configuration, while the orbiting scroll 7 performs an orbiting rotation by rotation of the crank shaft 6, refrigerant gas introduced into the compression chamber 21 can be compressed.

A structure for coupling the crank shaft 6 with the orbiting scroll 7 includes a hollow boss 7*b*, which protrudes downward from the center of a lower portion of the orbiting scroll 7, and a crank pin 10 which protrudes upward from the center of an upper end surface of the crank shaft 6 by a predetermined distance to be inserted into the hollow boss 7*b*. A bearing 11 is forcibly press-fitted in the boss 7*b*, and an eccentric bush 12 is rotatably coupled around the crank pin 10.

In addition, an Oldham's ring 9 serving as anti-rotation device is interposed between the main frame 2 and the orbiting scroll 7. An oil supply path 6*a* is vertically defined in the crank shaft 6 throughout the overall length of the crank shaft 6. A pair of upper and lower balancing weights 13 and 14 are arranged above and below the rotor 5, respectively, to prevent unbalanced rotation of the crank shaft 6 that may be caused by the crank pin 10.

If high-pressure refrigerant gas compressed in the above described compression unit is discharged through an outlet 17 of the fixed scroll 8, the high-pressure refrigerant gas imparts a direct shock to a top cap 1*a* constituting an upper end of the shell 1, thus causing generation of noise. Accordingly, to reduce the noise, a muffler 22 is mounted above the fixed scroll 8. The muffler 22, as shown in FIG. 2, takes the form of a cover.

In addition to this noise reduction function, the muffler 22 has a function of isolating a suction pressure from a discharge pressure, namely, a low-pressure portion from a high pressure portion when the scroll compressor has a high-pressure structure wherein a lower region of the compressor is filled with the high-pressure refrigerant gas discharged from the compression unit. The fixed scroll 8 has guidance paths 23 to guide the compressed refrigerant gas in the muffler 22 into the lower region of the compressor.

In FIG. 1, reference numerals 15 and 16 designate a suction pipe and discharge pipe, respectively, and reference numeral 18 designates a discharge chamber. Also, reference numerals 19 and 20 designate oil and an oil propeller, respectively.

In the scroll compressor having the above described configuration, if the rotor 5 rotates in the stator 4 upon receiving power, the crank shaft 6 is rotated by the rotor 5, thus causing the orbiting scroll 7, which is coupled to the crank shaft 6 by use of the crank pin 10, to perform an orbiting movement along an orbiting radius between the center of the crank shaft 6 and the center of the orbiting scroll 7.

Accordingly, the compression chamber 21, which is defined between the orbiting wrap 7*a* and the fixed wrap 8*a*, has a volume reduction by continuous orbiting movement of the orbiting scroll 7, resulting in compression of refrigerant gas suctioned thereinto. The compressed high-pressure refrigerant gas is discharged into the discharge chamber 18 through the outlet 17 of the fixed scroll 8. In turn, the refrigerant gas in the discharge chamber 18 is guided into the lower region of the compressor through the guidance paths 23 of the fixed scroll 8, and thereafter, is discharged to the outside through the discharge pipe 16.

FIG. 2 is a partially enlarged sectional view of FIG. 1.

As shown in FIG. 2, the main frame 2 has an oil supply screw 24. During operation of the compressor, the oil supply screw 24 allows oil, which is supplied through the crank shaft 6 into a backpressure space C1, which is defined between the orbiting scroll 7 and the main frame 2 and maintains a high pressure, into a space C2 which is defined between the fixed scroll 8 and the main frame 2 and maintains a low pressure.

The oil supply screw 24, as shown in FIG. 3, has a stepped screw body 25 having upper and lower portions of different diameters, The upper larger diameter portion of the screw body 25 is externally formed with screw threads 26, to allow the oil supply screw 24 to be screwed into a screw bore 2*a* formed in the main frame 2.

An orifice 27 is perforated through the center of the screw body 25. To allow an appropriate amount of oil to be supplied therethrough without interference of a discharge pressure of the oil, the orifice 27 includes a center hole 28 perforated in the upper portion of the screw body 25 and a slender hole 29 perforated in the lower portion of the screw body 25 to communicate with the center hole 28. The slender hole 29 has a smaller diameter than that of the center hole 28 and is drilled to be positioned at the center of the center hole 28.

However, in the oil supply screw of the conventional scroll compressor, since the slender hole constituting the orifice has an extremely small diameter and an entrance end thereof has a flat plane configuration, various impurities and sludge contained in the oil may accumulate at the entrance end, and be introduced into the slender hole of the oil supply screw.

Accordingly, there is a problem in that the slender hole of the oil supply screw may be clogged with the various impurities and sludge contained in the oil. This hinders an appropriate amount of oil to be supplied into the compression unit, and hence, results in deterioration in the performance and reliability of the compressor.

Another problem of the conventional oil supply structure of the scroll compressor is that the slender hole constituting the orifice of the oil supply screw has an extremely small diameter but also as an excessively long length as stated above, and thus, is difficult to be processed. As a result, the conventional oil supply structure suffers from an increase in processing price and thus, is not economical.

A further problem of the conventional scroll compressor is that oil is continuously supplied from the backpressure space having a high pressure into the space having a low pressure, thus causing an unnecessary increase in the supply amount of oil. Moreover, the oil is not supplied directly to thrust planes of the orbiting scroll and main frame, but supplied into the space between the fixed scroll and the main frame, resulting in inefficient oil supply.

Yet another problem is that the slender hole of the oil supply screw must have a very high slenderness ratio to satisfy a requirement for supplying an appropriate amount of oil into the scroll compressor. This disadvantages causes difficulty in hole processing as well as very poor yield (i.e. a low rate of the percentage of a theoretically expected supply amount of oil compared to the actually supplied amount of oil). The difficulty in hole processing becomes a factor of increasing high processing costs and the manufacturing costs of the compressor, and thus, results in degradation of economical efficiency.

SUMMARY OF THE INVENTION

Therefore, the present invention has been made in view of the above problems, and it is an object of the present invention to prevent a slender hole of an oil supply screw from being clogged with sludge, the oil supply screw being provided between a backpressure space, which is defined between an orbiting scroll and a main frame, and a space which is defined between a fixed scroll and the main frame, and adapted to supply oil from the backpressure space into the space.

It is another object of the present invention to prevent an orifice of an oil supply screw from being clogged with various impurities and sludge contained in oil while achieving ease in processing of the orifice.

It is a further object of the present invention to directly supply oil to thrust planes of an orbiting scroll and main frame while achieving an intermittent supply of oil from a backpressure space having a high pressure into a low pressure space.

It is yet another object of the present invention to prevent a slender hole of an oil supply screw from being clogged with various impurities and sludge, etc. contained in oil without a necessity for a high slenderness ratio related to the processing of the slender hole of the oil supply screw.

In accordance with a first aspect of the present invention, the above and other objects can be accomplished by the provision of an oil supply structure of a scroll compressor for supplying oil from a backpressure space, which is defined between an orbiting scroll and a main frame, into a space which is defined between a fixed scroll and the main frame, by use of an oil supply screw, which is screwed into a screw bore of the main frame perforated between the backpressure space and the space, wherein the oil supply screw includes; an orifice having a center hole longitudinally perforated through the center of an upper portion of a screw body of the oil supply screw and a slender hole continuously perforated below the center hole to have the same axis as that of the center hole; and a sludge discharger having a non-flat-plane configuration and formed at a lower entrance end of the screw body.

Preferably, the sludge discharger may be formed by a conical inclined surface at a periphery of the lower entrance end of the screw body.

Preferably, the screw body may have stepped upper and lower portions having different diameters from each other.

Preferably, the sludge discharger may be formed by a slender rod at the lower entrance end of the screw body, a plurality of reinforcing ribs being uniformly arranged along an outer periphery of the slender rod.

Preferably, each of the reinforcing ribs may have an inclined edge starting from the lower entrance end of the screw body.

In accordance with a second aspect of the present invention, the above and other objects can be accomplished by the provision of an oil supply structure of a scroll compressor for supplying oil from a backpressure space, which is defined between an orbiting scroll and a main frame, into a space which is defined between a fixed scroll and the main frame, by use of an oil supply screw which is screwed into a screw bore of the main frame perforated between the backpressure space and the space, comprising: a center hole longitudinally perforated through the center of an upper portion of a screw body of the oil screw; an eccentric hole longitudinally perforated through a lower portion of the screw body eccentric to the center of the center hole; and an oil supply hole formed by an overlapped portion of the center hole and eccentric hole.

Preferably, the center hole and eccentric hole may have different diameters from each other.

Preferably, the center hole and eccentric hole may have the same diameter as each other.

In accordance with a third aspect of the present invention, the above and other objects can be accomplished by the provision of an oil supply structure of a scroll compressor including an oil supply screw comprising: a center hole longitudinally perforated through the center of a lower portion of a screw body constituting the oil supply screw; an eccentric hole longitudinally perforated through an upper portion of the screw body eccentric to the center of the center hole; and an oil supply hole formed by an overlapped portion of the center hole and eccentric hole.

Preferably, the center hole and eccentric hole may have different diameters from each other.

Preferably, the center hole and eccentric hole may have the same diameter as each other.

In accordance with a fourth aspect of the present invention, the above and other objects can be accomplished by the provision of an oil supply structure of a scroll compressor comprising: an oil supply screw having a screw body and an orifice, the screw body including stepped upper and lower portions having different diameters from each other, and the orifice including a center hole and a slender hole, which are longitudinally perforated, respectively, through the center of the upper and lower portions of the screw body; and an intermittent oil supplier for supplying oil in a backpressure space, which is defined between an orbiting scroll and a main frame, into an Oldham's ring key groove of the orbiting scroll through the oil supply screw, the intermittent oil supplier being opened and closed by orbiting movement of the orbiting scroll.

Preferably, the intermittent oil supplier may include: an oil supply bore vertically defined in an upper portion of the main frame and configured to allow the oil supply screw to be screwed thereinto; and a communication bore horizontally defined in the main frame in a lateral direction of the backpressure space and adapted to communicate the oil supply bore with the backpressure space.

Preferably, the oil supply bore may have a centrally protruding stepped locking portion formed at a lower end thereof, the locking stepped portion defining an inlet hole.

Preferably, the communication bore may be perforated in the main frame in the lateral direction of the backpressure space and has one end in which a plug is screwed.

Preferably, the intermittent oil supplier may include an inclined oil supply bore obliquely perforated between the backpressure space and thrust planes of the main frame and orbiting scroll and configured to allow the oil supply screw to be screwed thereinto.

Preferably, the oil supply bore may have an oil passage formed at an upper end thereof and having a slightly larger diameter than that of the oil supply bore.

Preferably, the oil supply bore may further have a centrally protruding stepped locking portion formed at a lower end thereof and defining an inlet hole.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
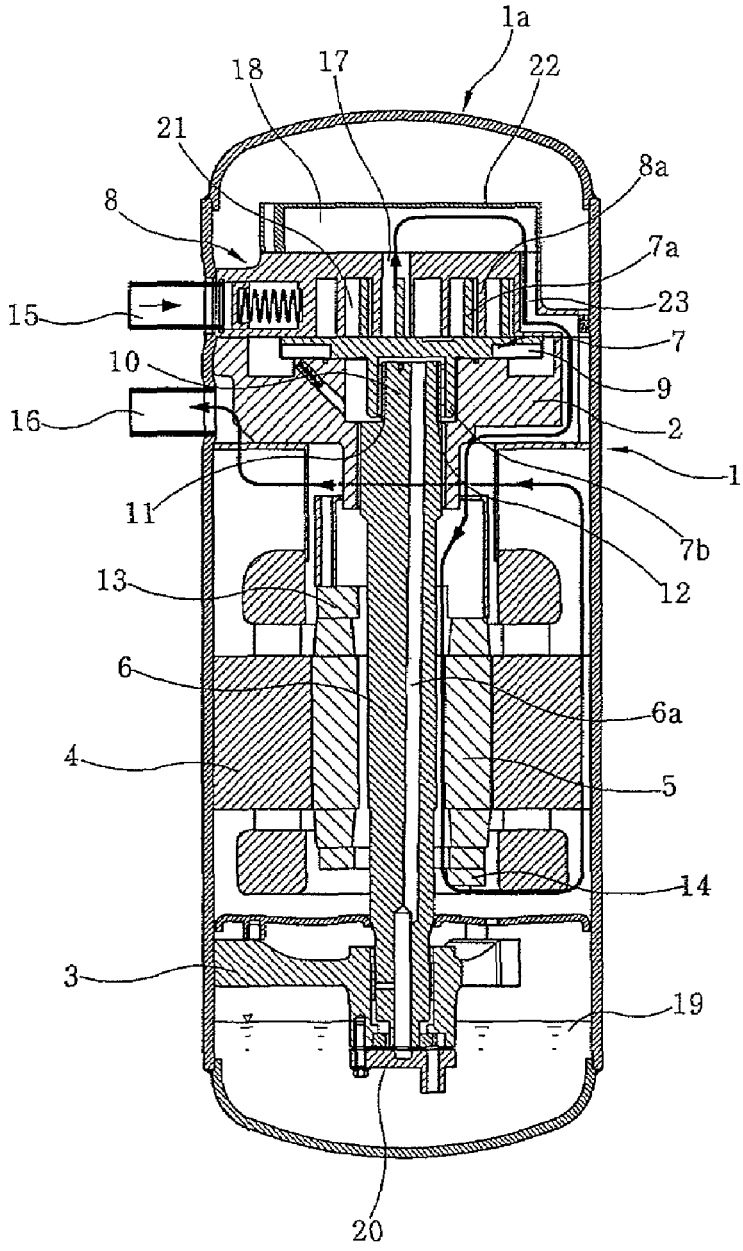
FIG. 1 is a longitudinal sectional view illustrating the inner configuration of a general scroll compressor.

Now, the configuration of the present invention will be explained in detail with reference to the accompanying drawings.

In the following description, the constituent elements of the present invention respectively corresponding to those of the prior art are designated by the same reference numerals.

Figure 2:
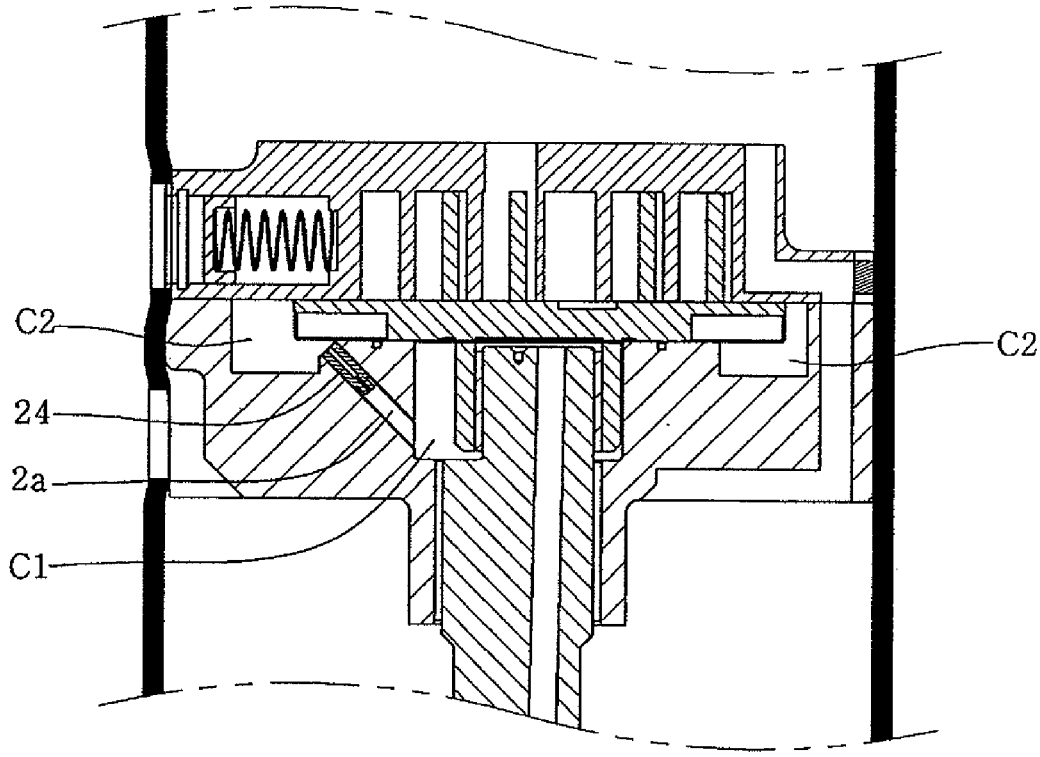
FIG. 2 is a partially enlarged sectional view of FIG. 1.

Similar to the prior art, the oil supply screw of a scroll compressor according to the present invention is configured to be screwed into the screw bore 2*a* of the main frame 2 perforated between the backpressure space C1 and the space C2 (See FIG. 2). Here, the backpressure space C1 is defined between the orbiting scroll 7 and the main frame 2 and maintains a high pressure, whereas the space C2 is defined between the fixed scroll 8 and the main frame 2 and maintains a low pressure.

Figure 3:
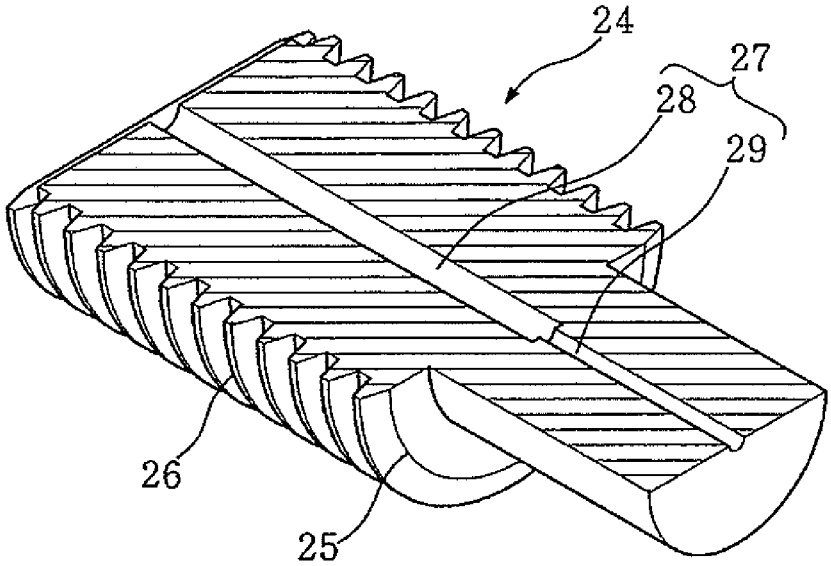
FIG. 3 is a half-cut perspective view illustrating the configuration of an oil supply screw of FIG. 2.

As shown in FIG. 3, the oil supply screw 24 has the screw body 25, which is externally formed with the screw threads 26 to allow the oil supply screw 24 to be screwed into the screw bore 2*a* of the main frame 2, and the orifice 27 perforated through the center of the screw body 25. Through the orifice 27, oil in the backpressure space C1 is able to be supplied into the space C2 defined between the fixed scroll 8 and the main frame 2.

The orifice 27 includes the center hole 28, which is longitudinally perforated through the center of the upper portion of the screw body 25, and the slender hole 29 perforated through the lower portion of the screw body 25 coaxially with the center hole 28.

The above described oil supply structure of the scroll compressor according to the present invention is characterized in that a lower entrance end of the oil supply screw 24*a* has a non-flat-plane configuration to provide a sludge discharger 30 in order to prevent various impurities and sludge, etc. contained in oil from accumulating at the lower entrance end of the oil supply screw 24.

Figure 4:
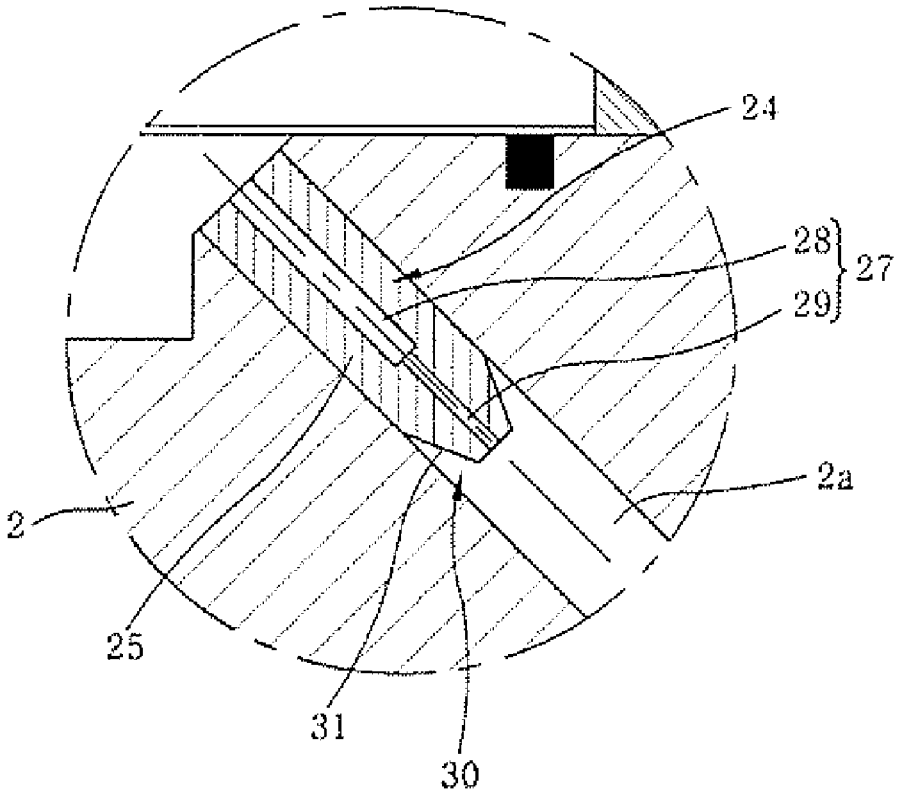
FIG. 4 is a partially enlarged sectional view illustrating an oil supply structure according to a first embodiment of the present invention.

Referring to FIG. 4 illustrating a first embodiment of the present invention in sectional view, the sludge discharger 30 may include a conical inclined surface 31 formed at a periphery of the lower entrance end of the oil supply screw 24. The steeper the inclined surface 31, the more easily the inclined surface 31 can achieve discharge of sludge.

Figure 5:
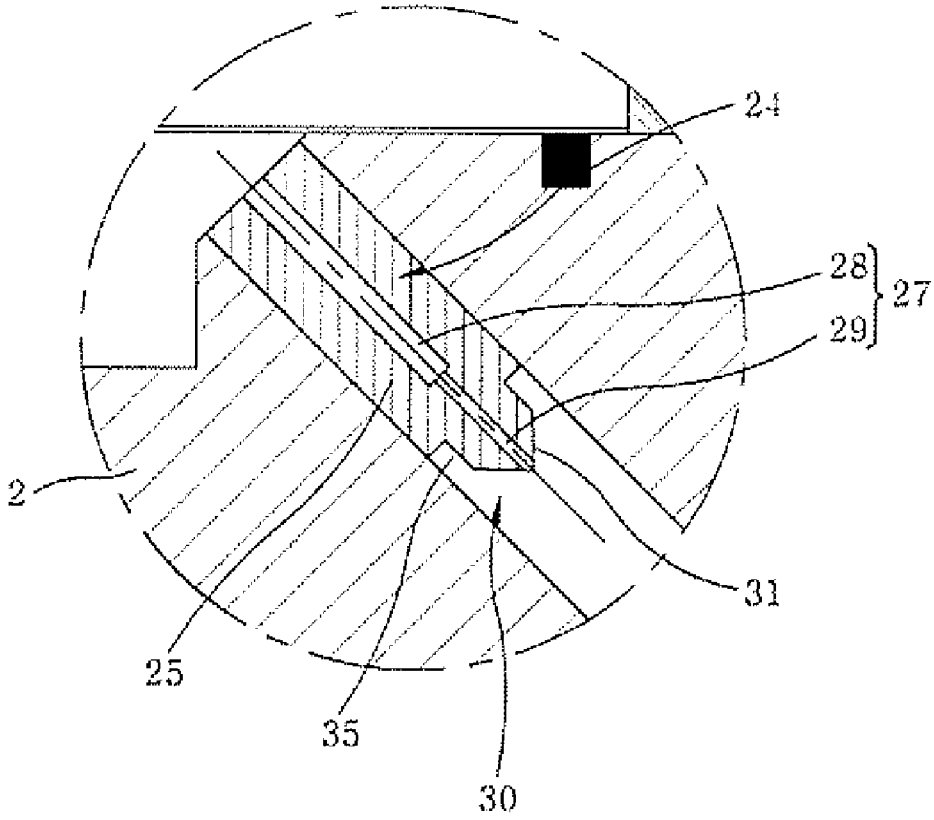
FIG. 5 is a partially enlarged sectional view illustrating an oil supply structure according to a second embodiment of the present invention.

Referring to FIG. 5 illustrating a second embodiment of the present invention in sectional view, in addition to the conical inclined surface 31 formed at a periphery of the lower entrance end of the oil supply screw 24, the screw body 25 of the oil supply screw 24 may have stepped upper and lower portions having different diameters from each other to define a sludge retaining space 35 between the screw body 25 and the screw bore 2*a* of the main frame 2.

With the above described configuration of the present embodiment, when sludge slides along the inclined surface 31 of the screw body 25 and is discharged from the oil supply screw 24, the sludge is guided into the sludge retaining space 35 around an outer peripheral surface of the screw body 25 having a different angle from that of the inclined surface 31, and thus, has no risk of being returned directly from the sludge retaining space 35 onto the inclined surface 31 of the screw body 25.

Figure 6A:
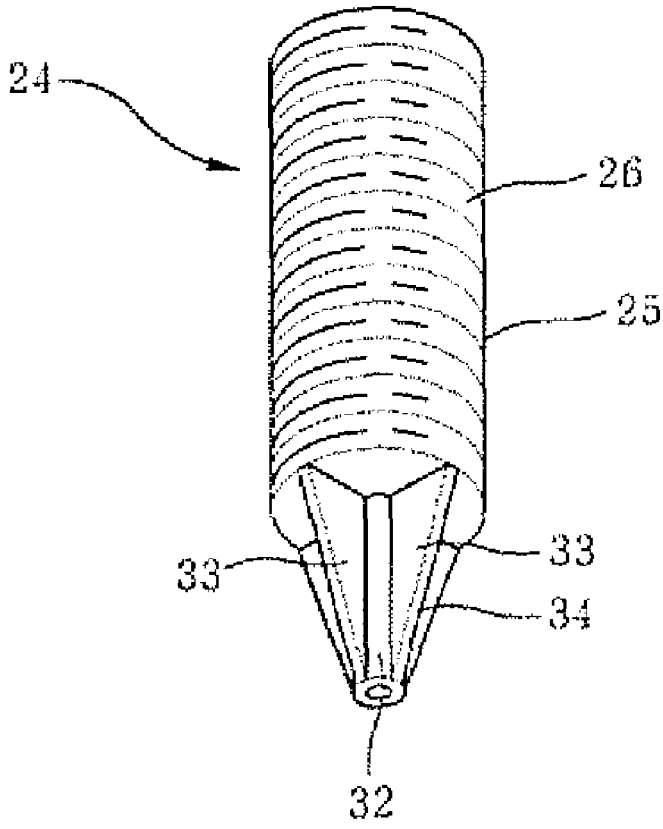
FIGS. 6A and 6B are a bottom perspective view and a partially enlarged sectional view, respectively, illustrating an oil supply screw according to a third embodiment of the present invention.
Figure 6B:
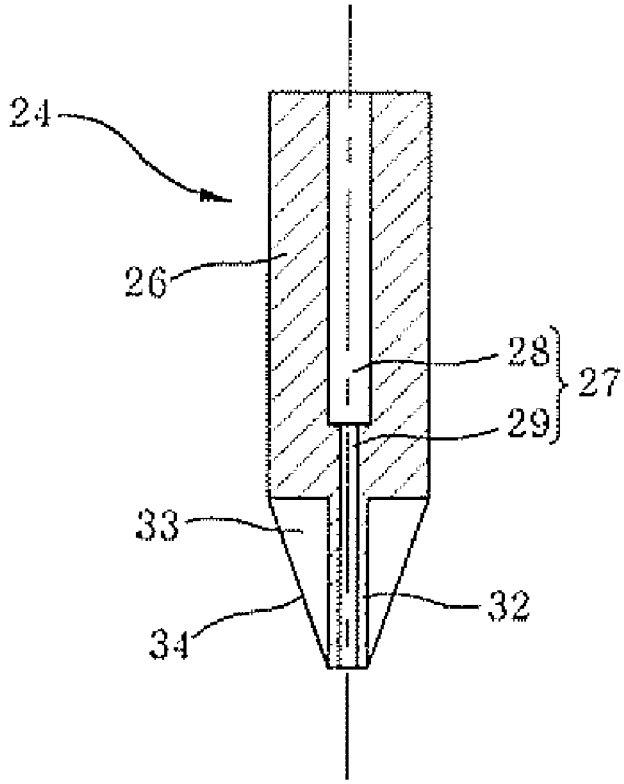

FIGS. 6A and 6B illustrate a third embodiment of the present invention, and more particularly, FIG. 6A is a bottom perspective view and FIG. 6B is a sectional view.

As shown, the sludge discharger 30 of the present embodiment may include a slender rod 32 forming a lower portion of the screw body 25, and a plurality of reinforcing ribs 33 uniformly arranged around the slender rod 32 to reinforce the structural strength of the slender rod 32. Here, the plurality of reinforcing ribs 33 may have approximately a cruciform arrangement and be shaped such that each has an inclined edge 34 starting from an entrance end of the screw body 25.

Figure 7:
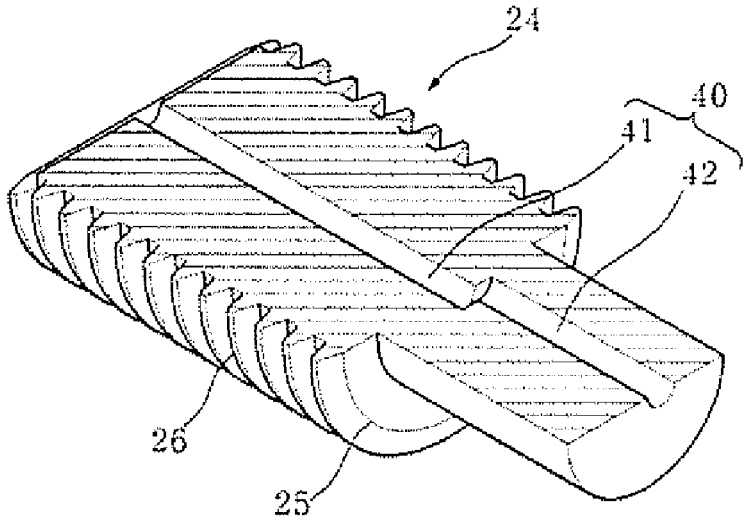
FIG. 7 is a half-cut perspective view illustrating the configuration of an oil supply screw according to a fourth embodiment of the present invention.

FIG. 7 is a half-cut perspective view illustrating the configuration of the oil supply screw according to a fourth embodiment of the present invention.

As shown, the oil supply screw 24 of the present embodiment is characterized in that an orifice 40 thereof includes a center hole 41 longitudinally perforated through the center of the upper portion of the oil supply screw 24, an eccentric hole 42 longitudinally perforated through the lower portion of the oil supply screw 24 eccentric to the center of the oil supply screw 24, and an oil supply hole 43 defined by an overlapped portion of the center hole 41 and eccentric hole 42.

The oil supply hole 43 is an actual oil supply passage of the oil supply screw 24. A supply amount of oil is proportional to the size of the oil supply hole 43, and the size of the oil supply hole 43 is inversely proportional to an eccentric distance S between the center hole 41 and the eccentric hole 42.

Figure 9:
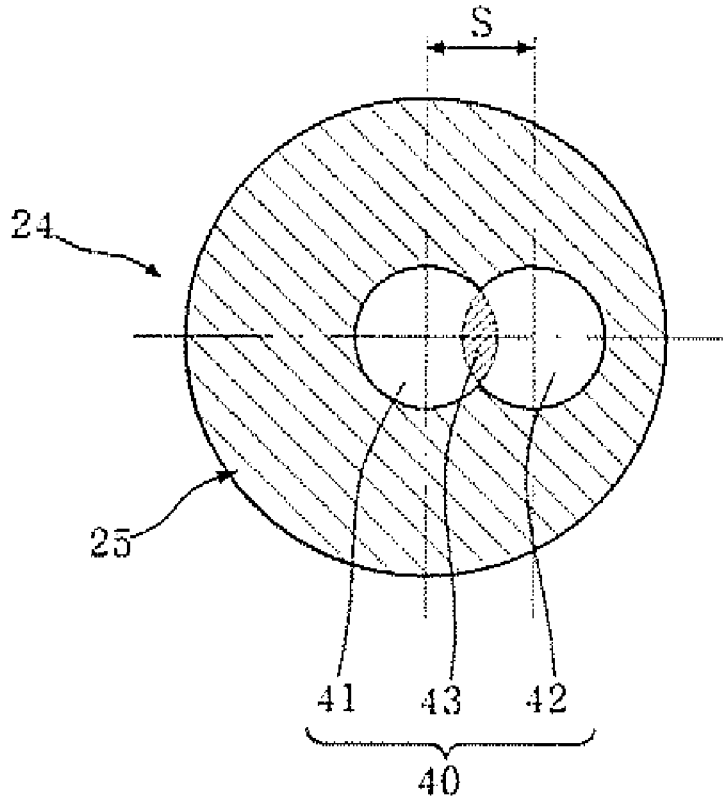
FIG. 9 is a sectional view taken along the arrowed lines A-A' of FIG. 8.

Explaining the oil supply hole 43 in more detail with reference to FIG. 9, when the center hole 41 and eccentric hole 42 have the same diameter as each other, the longer the distance between center axes of the center hole 41 and eccentric hole 42, namely, the longer the eccentric distance S of the eccentric hole 42 relative to the center of the center hole 41, the more an overlapping area between the center hole 41 and eccentric hole 42 decreases, resulting in a reduction in the supply amount of oil through the oil supply hole 43.

Conversely, the shorter the eccentric distance S of the eccentric hole 42 relative to the center of the center hole 41, the more the overlapping area between the center hole 41 and eccentric hole 42 increases, resulting in an increase in the supply amount of oil through the oil supply hole 43.

In addition, a depth of the eccentric hole 42 relative to the center hole 41 or a depth of the center hole 41 relative to the eccentric hole 42 is a factor of determining the supply amount of oil through the oil supply hole 43. That is, the supply amount of oil is proportional to the depth. Accordingly, the higher the height of the oil supply hole 43 between the overlapped center hole 41 and eccentric hole 42, the more the supply amount of oil through the oil supply hole 43 increases. Conversely, the lower the height of the oil supply hole 43, the more the supply amount of oil through the oil supply hole 43 decreases.

In this case, assuming that the oil supply hole 43 has the same size, the supply amount of oil through the oil supply hole 43 varies depending on the height of the oil supply hole 43. Accordingly, the supply amount of oil through the oil supply hole 43 can be regulated on the basis of various conditions depending on the size and height of the oil supply hole 43.

Figure 8:
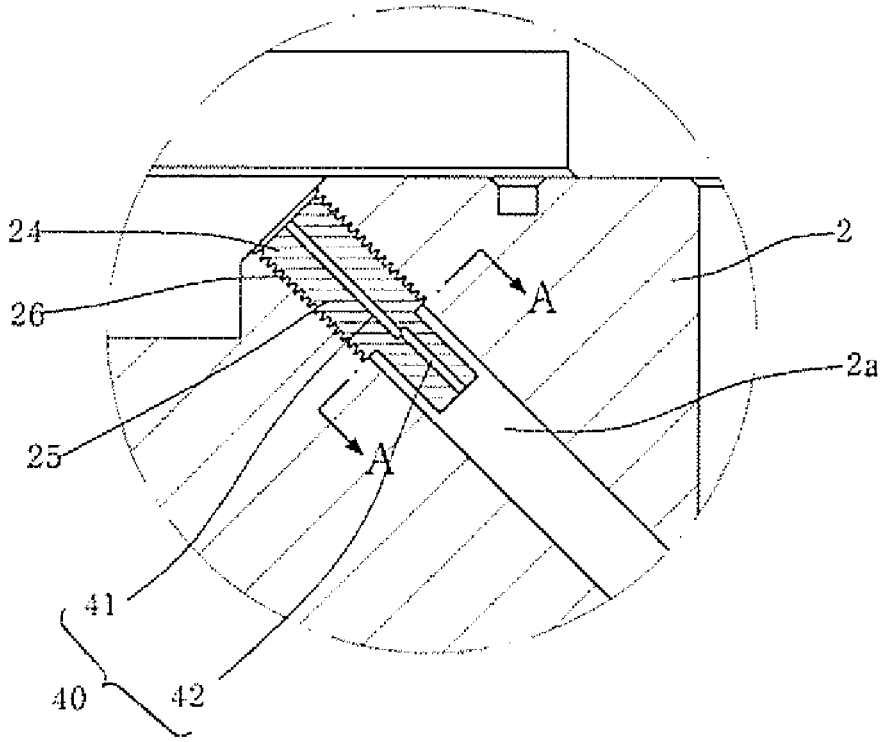
FIG. 8 is a sectional view illustrating the supply of oil through the oil supply screw of FIG. 7.

FIG. 8 is a sectional view illustrating the supply of oil through the oil supply screw according to the present invention.

As shown, if the compressor begins to operate, the backpressure space C1 between the orbiting scroll 7 and the main frame 2 forms a high pressure chamber, whereas the space C2 between the fixed scroll 8 and the main frame 2 forms a low-pressure chamber.

Also, the oil, which is stored in a lower region of the compressor, is supplied into the backpressure space C1 between the orbiting scroll 7 and the main frame 2 through the oil supply path 6*a* of the crank shaft 6. Subsequently, the oil is again supplied into the low-pressure space C2 between the fixed scroll 8 and the main frame 2 through the oil supply screw 24.

In this case, the supply of oil is achieved through the orifice 40 defined in the screw body 25 of the oil supply screw 24. The oil in the backpressure space C1 is first introduced into the eccentric hole 42, and then, is supplied into the center hole 41 by passing through the oil supply hole 43 that is defined by the overlapped eccentric hole 42 and center hole 41. Thereby, the oil is finally supplied into the space C2 between the fixed scroll 8 and the main frame 2.

As stated above, the supply amount of oil is determined on the basis of the size of the oil supply hole 43 between the center hole 41 and the eccentric hole 42 as well as the height of the oil supply hole 43 depending on the depth of the eccentric hole 42 relative to the center hole 41 or the depth of the center hole 41 relative to the eccentric hole 42. The size of the oil supply hole 43, as shown in FIG. 9, is inversely proportional to the eccentric distance S of the eccentric hole 42 relative to the center of the center hole 41.

Figure 10:
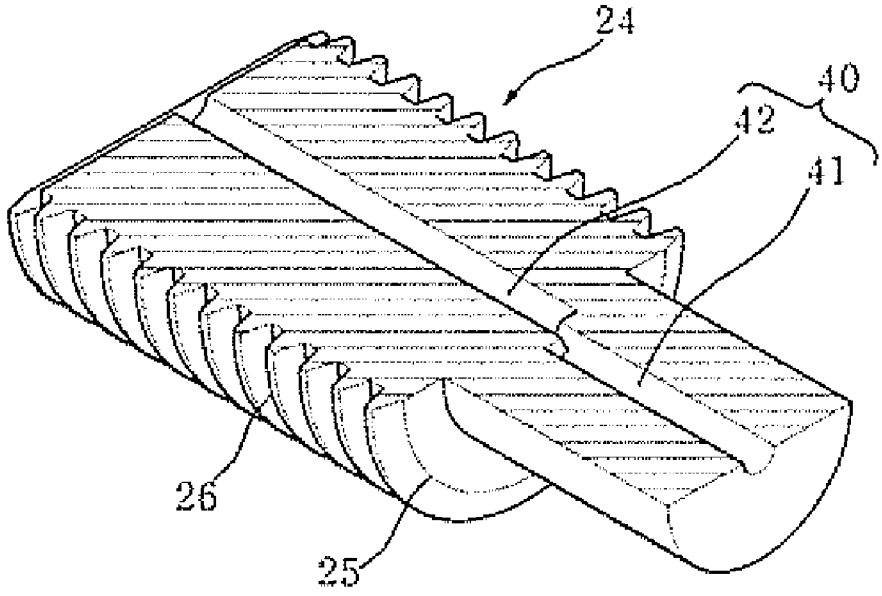
FIG. 10 is a half-cut perspective view illustrating the configuration of an oil supply screw according to a fifth embodiment of the present invention.

FIG. 10 is a half-cut perspective view illustrating the configuration of the oil supply screw according to a fifth embodiment of the present invention.

As shown, instead of forming the center hole 41 of the orifice 40 in the upper portion of the screw body 25 as described in the previously described embodiment of the present invention, the oil supply screw 24 of the present embodiment is characterized in that the orifice 40 thereof includes the center hole 41 longitudinally perforated through the center of the lower portion of the screw body 25, the eccentric hole 42 longitudinally perforated through the upper portion of the screw body 25 eccentric to the center hole 41, and the oil supply hole 43 defined by an overlapped portion of the center hole 41 and eccentric hole 42.

As will be understood from the present embodiment, the orifice of the oil supply screw may be modified in various manners on the basis of a variety of requirements for the orifice 40 of the screw body 25, for example, a requirement in that an oil discharge portion must be close to a lower side of the orbiting scroll 7 when oil is supplied to an upper side of the orbiting scroll, or other processing conditions of the center hole 41 and eccentric hole 42.

Figure 11:
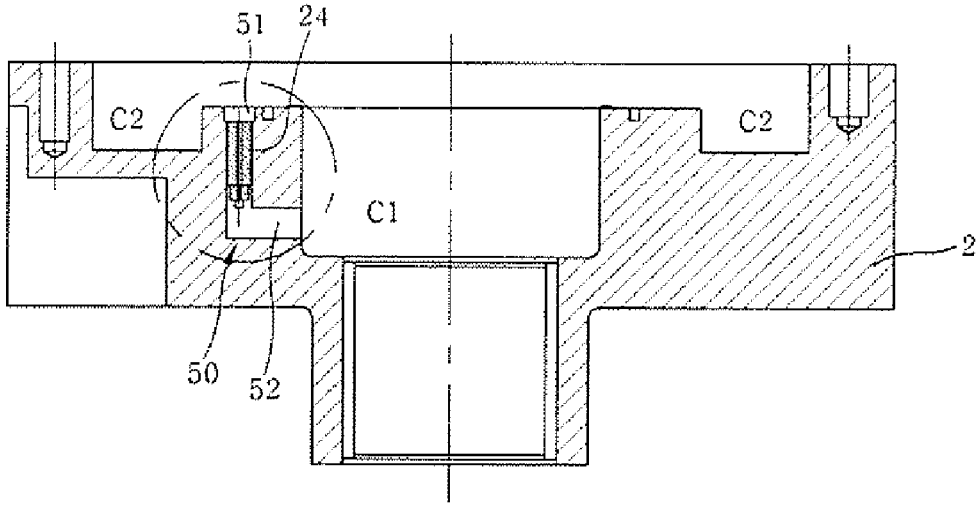
FIG. 11 is a partially enlarged sectional view illustrating an oil supply structure according to a sixth embodiment of the present invention.

FIG. 11 is a partially enlarged sectional view is illustrating an oil supply structure according to a sixth embodiment of the present invention.

As shown, the present embodiment is characterized in that an intermittent oil supplier 50 is provided to supply the oil in the backpressure space C1, which is defined between the orbiting scroll 7 and the main frame 2, into an Oldham's ring key groove 7*c* of the orbiting scroll 7 through the oil supply screw 24, the intermittent oil supplier 50 being opened and closed by orbiting movement of the orbiting scroll 7.

Figure 12:
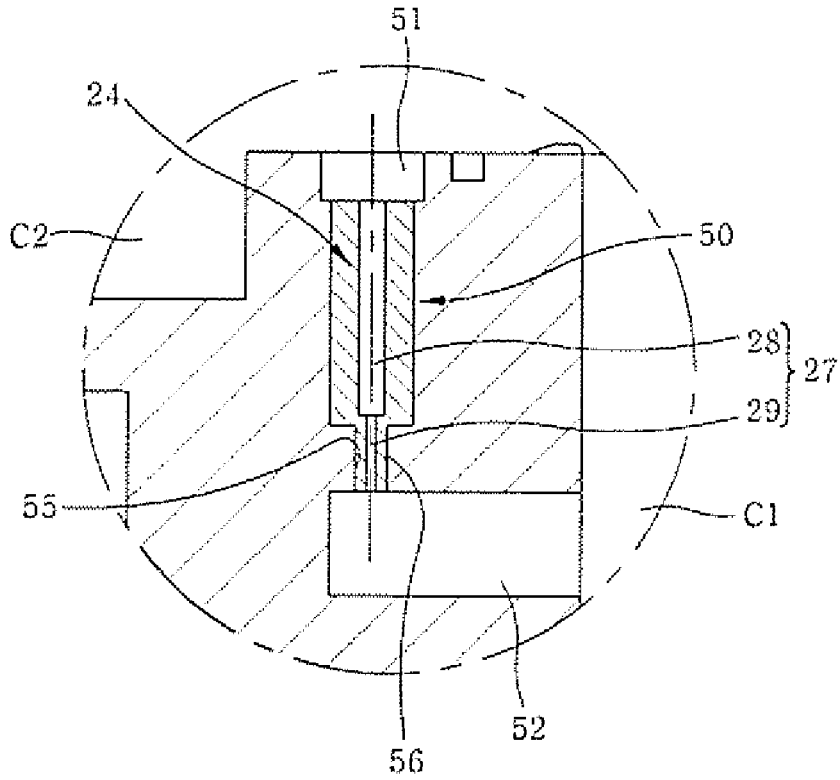
FIG. 12 is an enlarged sectional view of the circle "A" of FIG. 11.

As shown in FIG. 12, the intermittent oil supplier 50 includes an oil supply bore 51 vertically defined in an upper portion of the main frame 2 for allowing the oil supply screw 24 to be screwed thereinto, and a communication bore 52 horizontally defined in the main frame 2 in a lateral direction of the backpressure space C1 for allowing communication between the oil supply bore 51 and the backpressure space C1.

To prevent the oil supply screw 24 from being separated from the oil supply bore 51, the oil supply bore 51 has a centrally protruding stepped locking portion 56 formed at a lower end thereof. The centrally protruding stepped locking portion 56 is configured to centrally define an inlet hole 55, thus allowing the oil, having been passed through the communication bore 52, to be introduced into the oil supply bore 51.

Figure 13A:
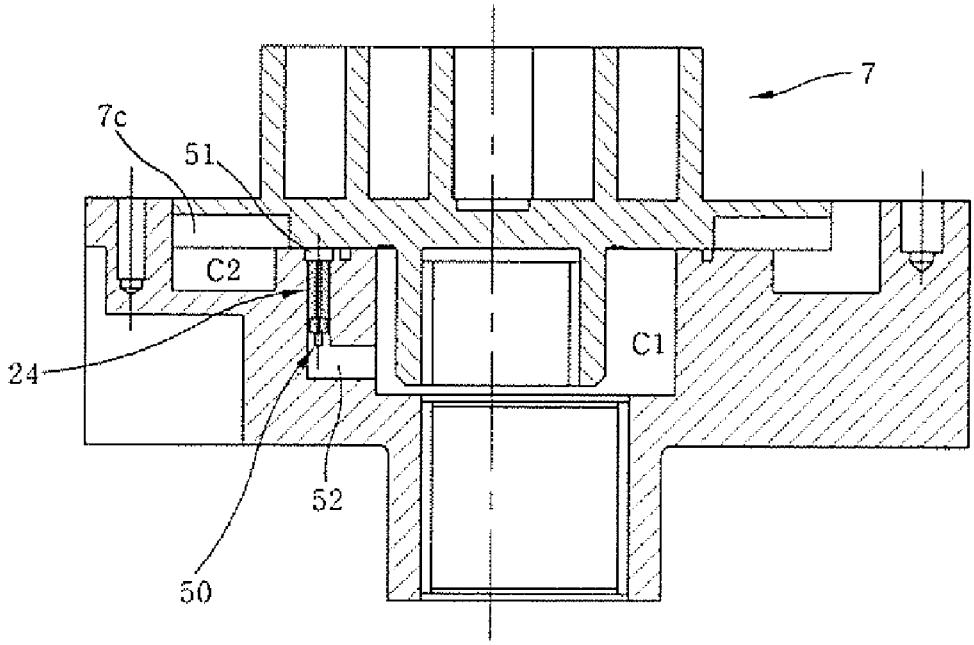
FIGS. 13A and 13B are partially enlarged sectional views illustrating a closed state and opened state of the oil supply structure of FIG. 11, respectively.
Figure 13B:
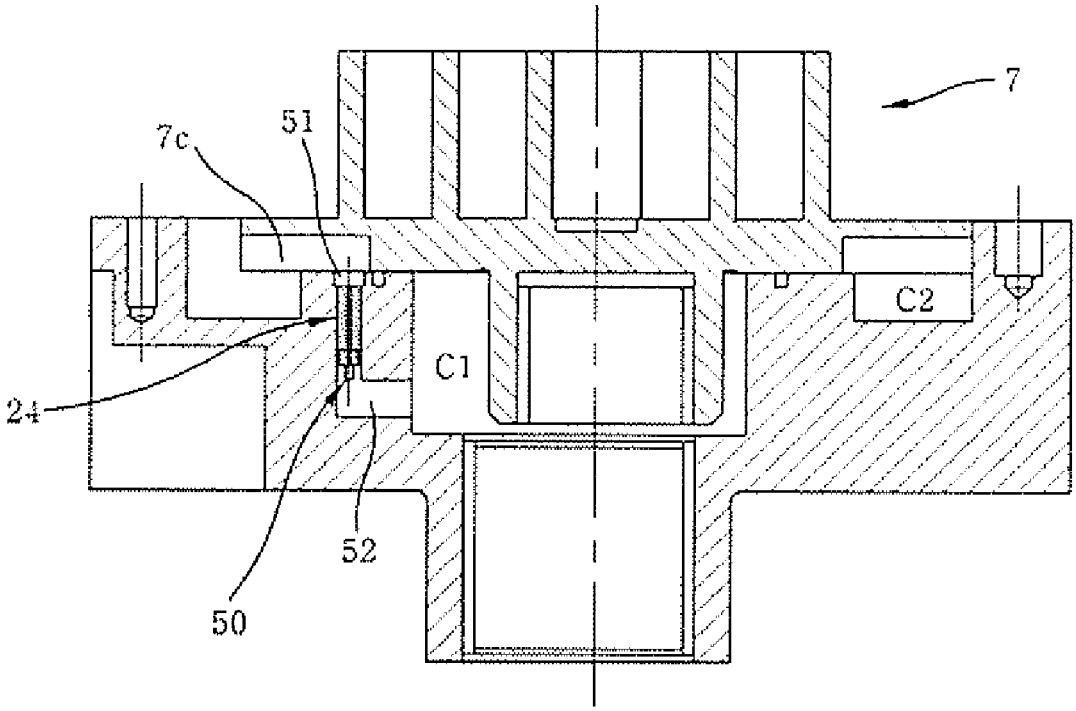

With the above described configuration of the present embodiment, as shown in FIGS. 13A and 13B, the oil supply bore 51, which is vertically perforated in the upper portion of the main frame 2, is opened and closed by orbiting movement of the orbiting scroll 7. FIG. 13A is a sectional view illustrating the closed state of the oil supply bore 51, whereas FIG. 138 is a sectional view illustrating the opened state of the oil supply bore 51.

As shown in FIG. 13A, when the oil is supplied into the backpressure space C1 between the orbiting scroll 7 and the main frame 2 through the oil supply path of the crank shaft, the oil first passes through the communication bore 52 to be introduced into the inlet hole 55, and then, is supplied into the oil supply bore 51 through the orifice 27 of the oil supply screw 24. In this case, if the oil supply bore 51 is closed by the orbiting scroll 7, there is no supply of oil.

Thereafter, as shown in FIG. 13B, if the Oldham's ring key groove 7*c* of the orbiting scroll 7 is located above the oil supply bore 51 by orbiting movement of the orbiting scroll 7, the oil supply bore 51 is opened, and thus, the oil is able to be supplied into the Oldham's ring key groove 7*c* of the orbiting scroll 7. With the repetitive opening/closing operations, intermittent oil supply operation can be accomplished.

Figure 14:
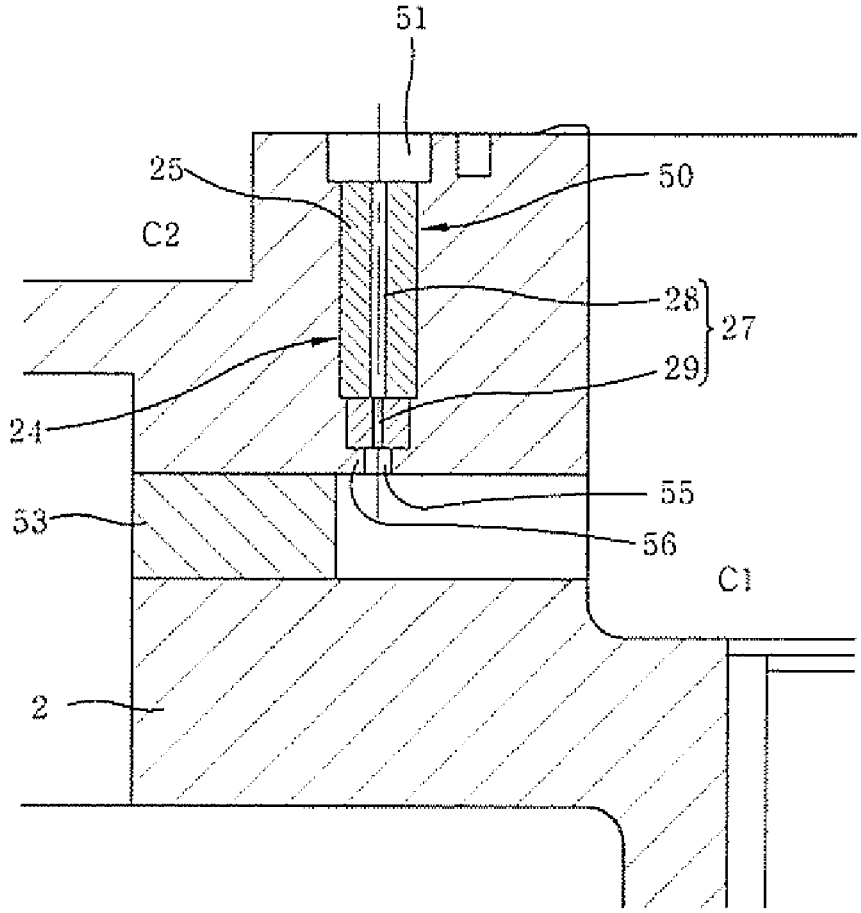
FIG. 14 is a partially enlarged sectional view illustrating an oil supply structure according to a seventh embodiment of the present invention.

FIG. 14 is a partially enlarged sectional view illustrating an oil supply structure according to a seventh embodiment of the present invention.

As shown, similar to the above sixth embodiment of the present invention, the present embodiment employs the intermittent oil supplier 50 for allowing the oil in the backpressure space C1, which is defined between the orbiting scroll 7 and the main frame 2, to be supplied into the Oldham's ring key groove 7*c* of the orbiting scroll 7 through the oil supply screw 24 as it is opened and closed by orbiting movement of the orbiting scroll 7.

The intermittent oil supplier 50 includes the oil supply bore 51 vertically defined in the upper portion of the main frame 2 for allowing the oil supply screw 24 to be screwed thereinto, and the communication bore 52 horizontally defined in the main frame 2 in a lateral direction of the backpressure space C1 for allowing communication between the oil supply bore 51 and the backpressure space C1.

The present embodiment is characterized in that the communication bore 52, which is perforated in the main frame 2 in the lateral direction of the backpressure space C1, has one end in which a plug 53 is screwed. As a result of separably screwing the plug 53 into the communication bore 52, there is an advantage in that cleaning of the communication bore 52 can be more easily performed.

In FIG. 14, reference numerals 55 and 56 designate inlet hole and centrally protruding stepped locking portion, respectively.

Figure 15:
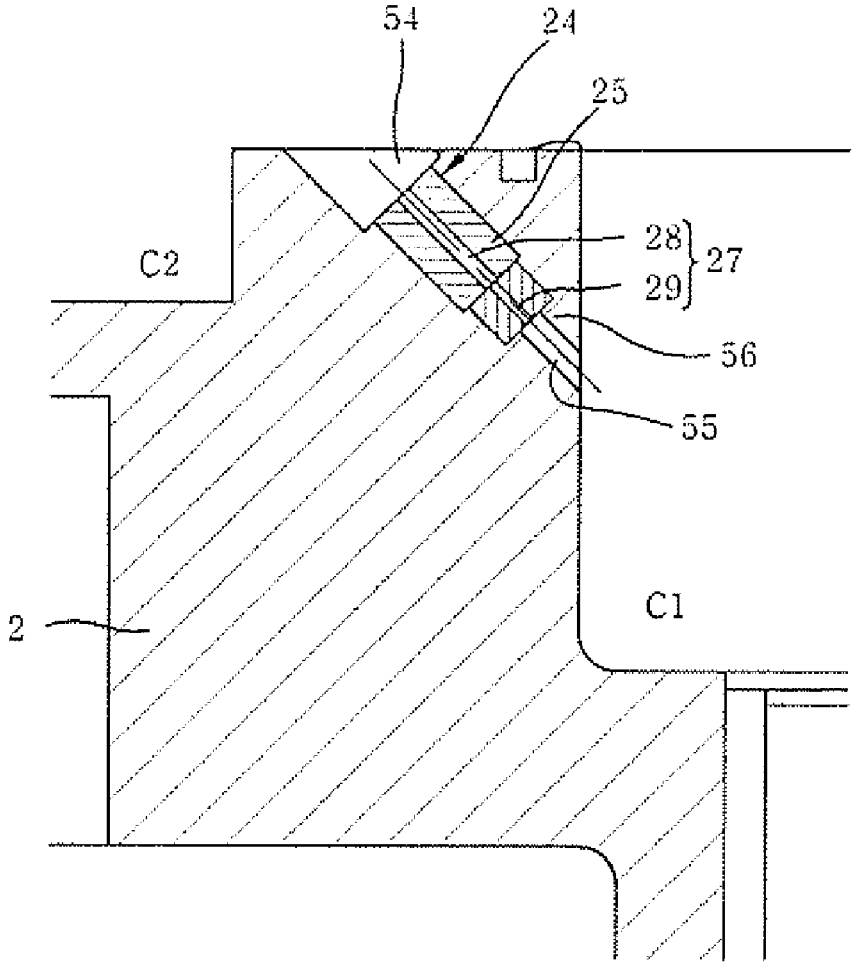
FIG. 15 is a partially enlarged sectional view illustrating an oil supply structure according to an eighth embodiment of the present invention.

FIG. 15 is a partially enlarged sectional view illustrating an oil supply structure according to an eighth embodiment of the present invention.

As shown, similar to the above sixth and seventh embodiments of the present invention, the present embodiment employs the intermittent oil supplier 50 for allowing the oil in the backpressure space C1, which is defined between the orbiting scroll 7 and the main frame 2, to be supplied into the Oldham's ring key groove 7*c* of the orbiting scroll 7 through the oil supply screw 24 as it is opened and closed by orbiting movement of the orbiting scroll 7.

The intermittent oil supplier 50 includes the inclined oil supply bore 51 obliquely perforated between the backpressure space C1 and thrust planes of the main frame 2 and orbiting scroll 7 for allowing the oil supply screw 24 to be screwed thereinto.

Similar to the above sixth and seventh embodiments of the present invention, the oil supply bore 51 is formed at an upper end thereof with an oil passage 54 having a slightly larger diameter than that of the oil supply bore 51, and at the lower end thereof with the centrally protruding stepped locking portion 56 for preventing the oil supply screw 24 from being separated from the oil supply bore 51, the centrally protruding stepped locking portion 56 defining the inlet hole 55.

Figure 16A:
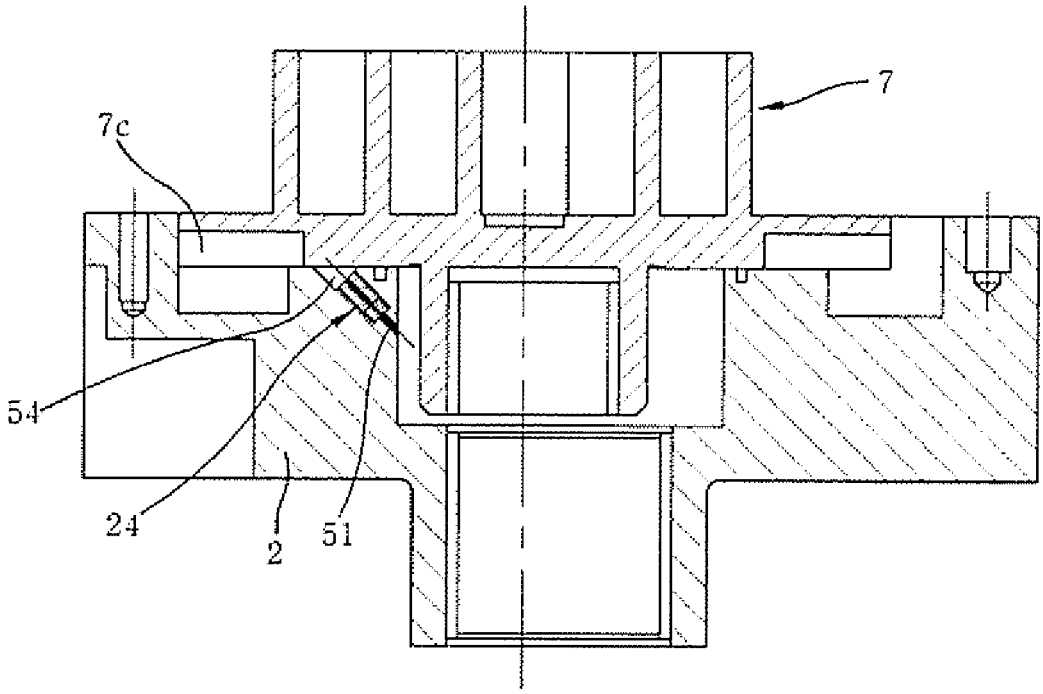
FIGS. 16A and 16B are partially enlarged sectional views illustrating a closed state and opened state of the oil supply structure of FIG. 15, respectively.
Figure 16B:
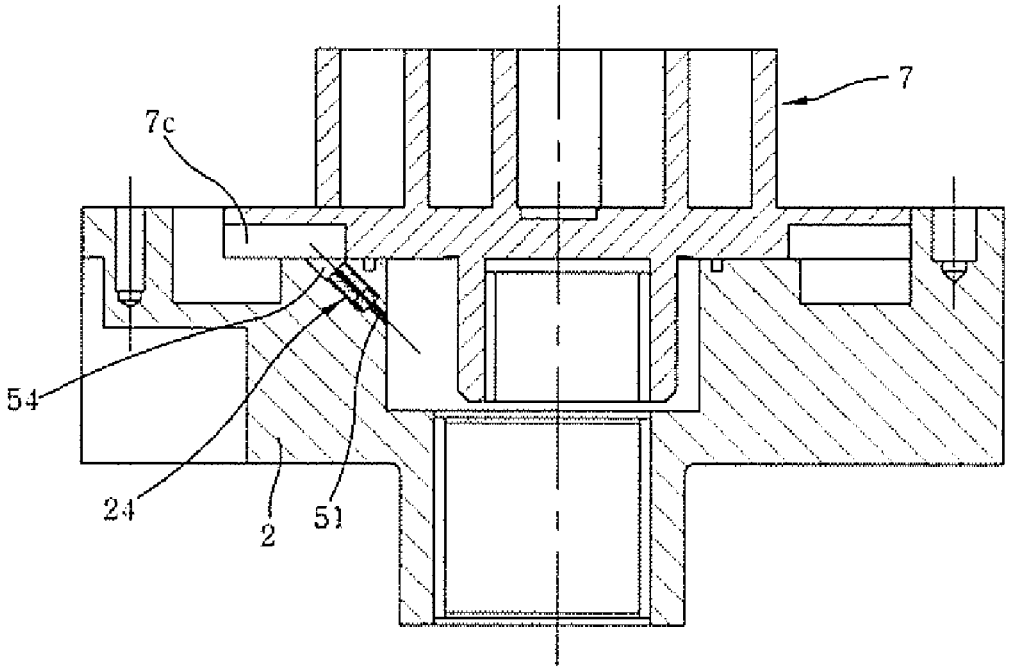

With the above described configuration of the present embodiment, as shown in FIGS. 16A and 16B, the oil supply bore 51, which is obliquely perforated in the main frame 2, is opened and closed by orbiting movement of the orbiting scroll 7. FIG. 16A is a sectional view illustrating the closed state of the oil supply bore 51, whereas FIG. 16B is a sectional view illustrating the opened state of the oil supply bore 51.

As shown in FIG. 16A, when the oil is supplied into the backpressure space C1 between the orbiting scroll 7 and the main frame 2 through the oil supply path of the crank shaft, the oil is supplied into the oil supply bore 51 through the orifice 27 of the oil supply screw 24. In this case, if the oil supply bore 51 is closed by the orbiting scroll 7, there is no supply of oil.

Thereafter, as shown in FIG. 16B, if the Oldham's ring key groove 7*c* of the orbiting scroll 7 is located above the oil supply bore 51 by orbiting movement of the orbiting scroll 7, the oil supply bore 51 is opened, and thus, the oil is able to be supplied into the Oldham's ring key groove 7*c* of the orbiting scroll 7. With the repetitive opening/closing operations, intermittent oil supply operation can be accomplished.

As apparent from the above description, the oil supply structure of a scroll compressor according to the present invention has the following several effects.

Firstly, the present invention employs a sludge discharger having a non-flat-plane configuration, which is provided at an entrance end of an oil supply screw between a backpressure space, which is defied between an orbiting scroll and a main frame, and a space between a fixed scroll and the main frame. Providing the sludge discharger has the effect of preventing a slender hole of the oil supply screw from being clogged with sludge, and thus allowing an appropriate amount of oil to be supplied into a compression unit, This results in improvement in the performance and reliability of the compressor.

Secondly, according to the present invention, to supply oil from the backpressure space between the orbiting scroll and the main frame into the space between the fixed scroll and the main frame, the oil supply screw, which is installed in the main frame between both the spaces, has an orifice in the combination of a center hole, eccentric hole and communication bore. With this configuration, simplified easy orifice processing and thus, reduced processing costs can be advantageously accomplished.

Thirdly, the orifice in the combination of the center hole, eccentric hole and communication bore is efficient to prevent the orifice from being clogged with various impurities and sludge contained in oil, As a result, proper supply of oil through the oil supply screw can be accomplished, resulting in improvement in the performance and reliability of the compressor.

Fourthly, according to the present invention, oil can be intermittently supplied from the backpressure space having a high pressure into the low pressure space without requiring separate supply elements or devices. Also, the oil can be directly supplied to thrust planes of the orbiting scroll and main frame. This has the effect of achieving high economical efficiency in the manufacture of the compressor as well as high oil supply efficiency while preventing excessive supply of oil into the compression unit.

Fifthly, by virtue of the intermittent oil supply into the compression unit as stated above, the present invention has the effect of eliminating a necessity for a high slenderness ratio of the slender hole of the oil supply screw and achieving an increase in the diameter of the slender hole. Accordingly, as compared to a slender hole of conventional oil supply screws requiring a high slenderness ratio, the present invention has the effect of reducing processing costs of the slender hole while achieving increased yield, and preventing the slender hole from being clogged with various impurities and sludge, etc. contained in oil, resulting in improvement in the performance and reliability of the compressor.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An oil supply structure of a scroll compressor for supplying oil from a backpressure space, which is defined between an orbiting scroll and a main frame, into a space which is defined between a fixed scroll and the main frame, by use of an oil supply screw, which is screwed into a screw bore of the main frame perforated between the backpressure space and the space, wherein the oil supply screw includes:

an orifice having a center hole longitudinally perforated through the center of an upper portion of a screw body of the oil supply screw and a slender hole continuously perforated below the center hole to have the same axis as that of the center hole; and a sludge discharger having a non-flat-plane configuration and formed at a lower entrance end of the screw body, the sludge discharger being formed by a slender rod at the lower entrance end of the screw body, a plurality of reinforcing ribs being uniformly arranged along an outer periphery of the slender rod.

2. The oil supply structure according to claim 1, wherein the sludge discharger is formed by a conical inclined surface at a periphery of the lower entrance end of the screw body.

3. The oil supply structure according to claim 2, wherein the screw body has stepped upper and lower portions having different diameters from each other.

4. The oil supply structure according to claim 1, wherein each of the reinforcing ribs has an inclined edge starting from the lower entrance end of the screw body.

* * * * *